US009010245B2

(12) United States Patent
Püschel et al.

(10) Patent No.: US 9,010,245 B2
(45) Date of Patent: Apr. 21, 2015

(54) OPERATION OF A COLD FOIL APPARATUS BY A PRINTING PRESS

(75) Inventors: Uwe Püschel, Heidesheim (DE); Jürgen Schölzig, Mainz (DE)

(73) Assignee: manroland sheetfed GmbH, Offenbach/Main (DE)

( * ) Notice: Subject to any disclaimer, the term of this patent is extended or adjusted under 35 U.S.C. 154(b) by 417 days.

(21) Appl. No.: 13/141,010

(22) PCT Filed: Dec. 3, 2009

(86) PCT No.: PCT/EP2009/066350

§ 371 (c)(1),
(2), (4) Date: Aug. 16, 2011

(87) PCT Pub. No.: WO2010/072538

PCT Pub. Date: Jul. 1, 2010

(65) Prior Publication Data

US 2011/0290139 A1 Dec. 1, 2011

(30) Foreign Application Priority Data

Dec. 23, 2008 (DE) ..... 10 2008 055 142

(51) Int. Cl.
*B41F 1/16* (2006.01)
*B41F 16/00* (2006.01)
*B41F 19/06* (2006.01)

(52) U.S. Cl.
CPC ..... *B41F 16/00* (2013.01); *B41F 19/06* (2013.01)

(58) Field of Classification Search
CPC ..... B41F 16/0006; B41F 16/006
USPC ..... 101/492, 25
See application file for complete search history.

(56) References Cited

U.S. PATENT DOCUMENTS 5,115,737 A * 5/1992 Amendola ..... 101/32

FOREIGN PATENT DOCUMENTS

DE 2006056896 A1 6/2007
WO WO 2007/045431 A1 4/2007

OTHER PUBLICATIONS

International Preliminary Report on Patentability in corresponding PCT Application No. PCT/EP2009/066350, dated Aug. 2, 2011.
International Search Report in corresponding PCT Application No. PCT/EP2009/066350, dated Feb. 16, 2010.

* cited by examiner

*Primary Examiner* — Matthew G Marini
(74) *Attorney, Agent, or Firm* — Leydig, Voit & Mayer, Ltd.

(57) ABSTRACT

A method of transferring a transfer foil having an image forming layer through a transfer gap of a printing press under a foil cycle timing control that is selectively changeable such that it can be turned on, turned off, or is adjustable in its frequency and period of operation as a function of operating parameters of the press.

6 Claims, 2 Drawing Sheets

OPERATION OF A COLD FOIL APPARATUS BY A PRINTING PRESS

CROSS-REFERENCE TO RELATED APPLICATIONS

This patent application is the national phase of PCT/EP2009/066350, filed Dec. 3, 2009, which claims the benefit of German Patent Application No. 10 2008 055 142.2, filed Dec. 23, 2008

FIELD OF THE INVENTION

The present invention relates generally to printing machines, and more particularly, to an improved method for transferring image-forming layers from a carrier foil to printing sheets in a printing press.

BACKGROUND OF THE INVENTION

It is known to produce metallic layers on printing sheets by means of a foil-transfer method. For example, in EP 0 569 520 B1 a sheet-processing press is shown that has a feeder system and a delivery system, wherein printing units and a coating unit are arranged between the two systems. In at least one of the printing units, an adhesive pattern is applied by means of the planographic method in order to carry out a so-called cold-foil transfer method.

In the transport of printing sheets through the printing unit, each printing sheet is thereupon provided with an adhesive pattern. Then the printing sheet is guided through a coating unit, wherein, by means of a press roller, the printing sheet lying on an impression cylinder is brought into contact with the foil material. Here, the metallic layer assumes an intimate connection with the regions on the printing sheet provided with adhesive. After the further transportation of the printing sheet, the metallic layer bonds merely in the region of the pattern provided with adhesive. Thus, the metallic layer is removed from the carrier foil in the region of the adhesive pattern. The transfer foil consumed in this way is wound up again. The printing sheet is thereupon delivered in the coated state.

It is known to use such coating units, for example, in printing units of printing presses. A disadvantage in known devices is that their use often does not have sufficient flexibility for efficient applicability to particular printing requirements.

OBJECTS AND SUMMARY OF THE INVENTION

It is an object of the present invention to provide a system that is operable for more efficient, economical, and reliable transfer of image-forming layers to printing sheets.

According to the invention, the coating unit of the printing machine has a control so that the foil cycle timing or the frequency and period of the foil cycle timing are set as a function of the machine speed or the length of the application pattern or the required transfer quality.

The system can thereby be advantageously used to improve foil utilization, particularly when the transfer foil is divided into one or more sub-foil webs of smaller width. In combination with the previously mentioned method, different foil types could also be used one next to the other.

Other objects and advantages of the invention will become apparent upon reading the following detailed description and upon reference to the drawings, in which:

Figure 1:
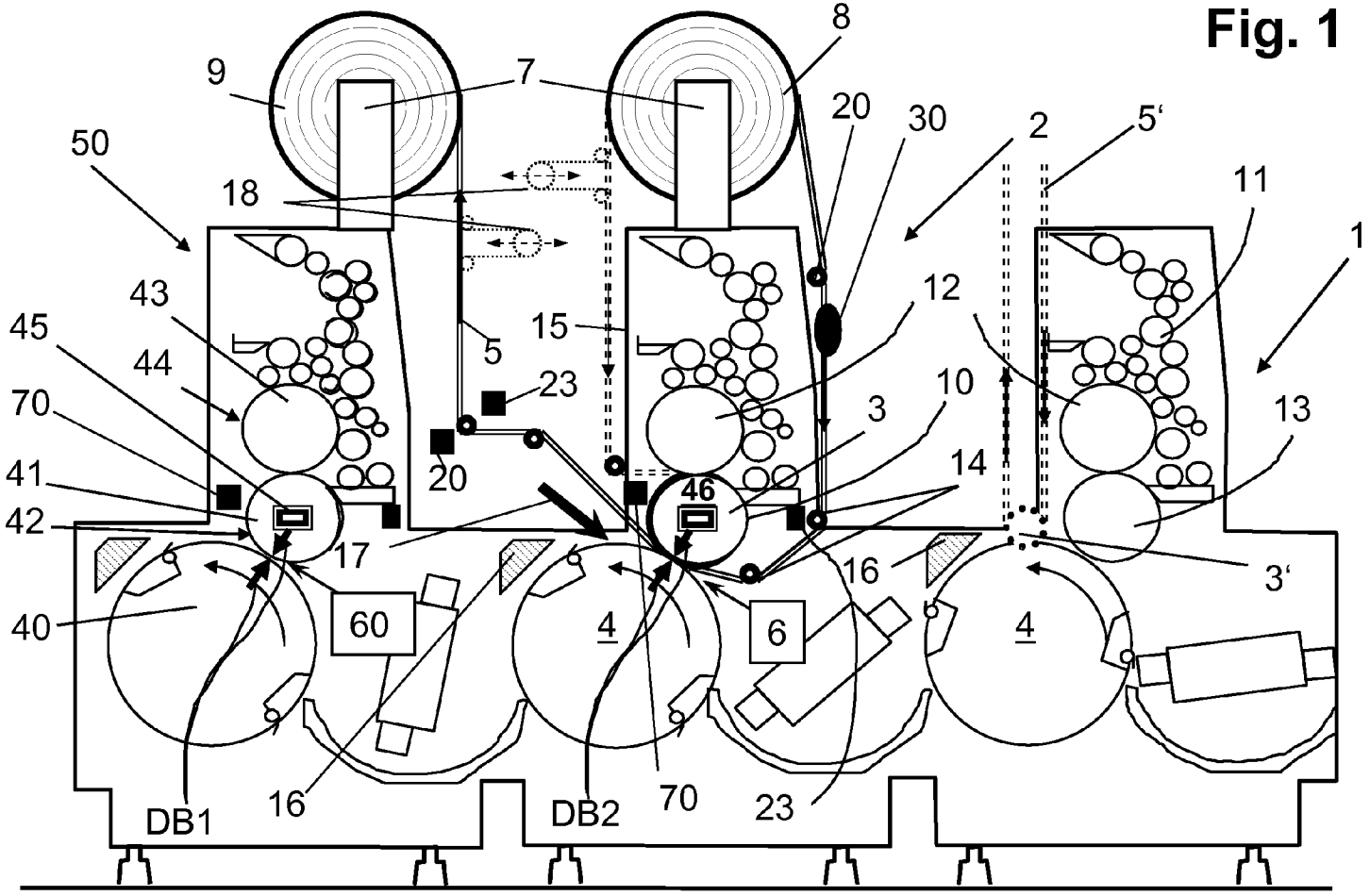
FIG. 1 is a diagrammatic depiction of an illustrated printing press with a foil-transfer mechanism in accordance with the invention.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DESCRIPTION OF THE PREFERRED EMBODIMENTS

Referring now more particularly to FIG. 1 of the drawings there is shown an illustrative sheet processing or printing machine that includes at least two printing or application units, namely an application unit 1 and a coating unit 2. In the first printing or application unit 1, a printing sheet is provided with an image-forming adhesive pattern. Then, in the next printing or application unit, namely the coating unit 2 a transfer foil 5 is guided together with a printing sheet through a transfer gap 6, wherein the transfer foil 5 is pressed in the transfer gap 6 against the printing sheet.

The application unit 1 may be a known offset printing unit with an inking unit 11, a plate cylinder 12, a blanket cylinder 13, and a sheet-guiding impression cylinder 4. This could likewise be a so-called coating module in which the blanket cylinder 13 is constructed as a forme cylinder. The forme cylinder is supplied with adhesive from a mechanism constructed, e.g., as an ink chamber blade system, instead of from the inking unit 11.

The transfer gap 6 in the coating unit 2 is formed by a press roller 3 and an impression cylinder 4. Here, the press roller 3 corresponds to the blanket cylinder and the impression cylinder 4 corresponds to the impression cylinder of an offset printing unit. Furthermore, the press roller 3 could correspond to the forme cylinder and the impression cylinder 4 could correspond to the impression cylinder of a coating module of a sheet-fed printing press. For this purpose, the coating unit 2 could also be constructed as a base unit of a printing unit with only one impression cylinder 4 and one press roller 3 present for performing the sheet transport and the transfer process in the transfer gap 6 in connection with corresponding foil unwinders and rewinders that are provided.

The transfer foils 5 have a multi-layer configuration. They have a carrier layer on which an image-forming layer is deposited by means of a separating layer. The separating layer is used for facilitating lifting of the image-forming layer from the carrier layer. The image-forming layer could be, e.g., a metalized layer or a glossy layer or a textured layer or an inked layer or a layer containing one or more image patterns.

The foil supply roller 8 is allocated to the coating unit 2 on the side of a sheet feeding system of the printing machine. The foil supply roller 8 has a controllable rotary drive 7 for the continuous regulated feeding of the transfer foil to the coating unit 2. Furthermore, in the region of the foil feeder, a deflection or tensioning roller is provided. In this way, the foil web of the transfer foil is always held at the same tension relative to the press roller 3. On the outlet side of the printing unit, a foil take-up roller 9 is provided onto which the consumed foil material is wound up again. Here, for the optimized production, a controllable rotary drive 7 is also provided. The transfer foil 5 could also be moved essentially by the rotary drive 7 on the outlet side and could be held taut by means of a brake on the feed side.

The transfer process of the image-forming, e.g., the transfer of the metalized layer onto the printing paper, is performed in the transfer gap 6 between the press roller 3 and the impression cylinder 4.

Likewise, as indicated in FIG. 1, a press roller 3' allocated to the impression cylinder 4 could be arranged in the application unit 1 after the transfer gap between blanket cylinder 13 and impression cylinder 4. By means of the press roller 3', a transfer foil 5' could be directed to a sheet held on the impression cylinder 4 so that the transfer of the image-forming or metallization layer could be effected there directly after the image-forming adhesive application.

The press roller 3 is preferably provided with a press covering 10, e.g., as a plastic coating, comparable with a rubber blanket or printing blanket. The press covering 10 is held in a cylinder channel by tensioning devices.

For enhancing the cost-effectiveness of the coating method, the foil advance of the transfer foil 5 from the foil supply roller 8 to the transfer gap 6 and to the foil take-up roller 9 is controllable such that, as much as possible, the transfer foil 5 is stopped when no transfer of the image-forming layer is to be effected. To this end, control of the transfer foil 5 could be performed so that when passing through a cylinder channel holding grippers of the sheet-guiding impression cylinder 4, the foil advance is stopped. Improved foil utilization also can be achieved if the transfer foil 5 is divided into one or more sub-foil webs of smaller width.

Within the coating unit 2 used for the foil transfer, a web guide for transfer foils 5 is shown that has foil guide rollers 14 by means of which the transfer foil 5 is fed into and discharged away from the transfer gap 6. Openings arranged according to the foil guide are provided in safeguards 15 present on the coating unit 2. These openings are shaped so that the foil webs 5 can be easily fed and discharged and so that, at the same time, the protective function is maintained.

In FIG. 1, three alternative variants of a web guide are shown.

a. The transfer foil 5 is guided from the side of the coating unit 2 facing the application unit 1 into the transfer gap 6, approximately tangential to the press roller 3 through the transfer gap 6 and discharged on the opposite side.

b. The transfer foil 5 (dashed) is discharged from the side of the coating unit 2 facing away from the application unit 1 toward the press roller 3, around the press roller 3, through the transfer gap 6, and onto the same side again.

c. The transfer foil 5' (dashed) is fed into the application unit 1 on the side of the printing unit facing away from the sheet feeder into a transfer gap 6' between the press roller 3' and the impression cylinder 4 and discharged again from there, wherein the transfer gap 6' is adjacent a printing gap used for inking and adhesive printing between the blanket cylinder 13 and the impression cylinder 4.

In FIG. 1, as a main embodiment, an approximately tangential foil guide is provided between the press roller 3 and the impression cylinder 4 with respect to the press roller 3, or alternatively the wrapping of the foil about the press roller 3 is less than 90 degrees. This achieves a defined contact of the foil web 5 on the press roller 3 and simultaneously creates the necessary prerequisites for a foil cycle timing or a foil stoppage in the transfer gap 6 during a channel passage, but also for the use of narrow foil webs 5.

The transport of the transfer foil 5 can be monitored on or between foil guide rollers by means of testing the web tension of the foil web 5. In a foil web guide, one or more web-tension measurement devices are provided for this purpose.

Furthermore, for the stabilization of the foil web 5 between a first deflection roller and a first run-in roller to the transfer unit, a stabilization mechanism can be arranged in order to reduce fluttering movements of the foil web 5. The stabilization mechanism has, e.g., two rollers that are supported so that they can rotate, and is provided for the adjustable setting of the wrapping angle of the foil web 5 on the guide rollers so that the guide effect and the damping effect on the foil web 5 is adjustable according to the operating state. The setting of the stabilization mechanism can be performed in connection with a web tension regulation and optionally a sensor mechanism for monitoring web rupture.

Electrical signals of the web-tension measurement mechanisms are evaluated. To this end, different operating states are possible:

1. A web tension above a minimum value can be specified that is evaluated as a signal for the presence of the foil web 5 and fed to a machine controller.

2. Exceeding of the maximum value of the web tension that can be specified is reduced by means of dancer rollers 18 or roller drives 7 of the foil supply 8 or take-up roller 9. In this way, impermissible web elongation or web tearing can be avoided.

3. When falling below the minimum web tension that is specified, a check is made as to whether the web tension control is still active. If an increase in the web tension is not possible by means of dancer rollers 18 or a brake, web tearing is identified.

The additional information obtained concerning the web tension can be used as an actual value, in particular, in relationship with the evaluations for the control of the printing or transfer process. To this end, the system can be connected to a control panel 80 of the printing press. By means of the control panel 80, the desired values for maximum and minimum web tension can be input. These can be dependent on the type of transfer foil 5 being used and on the printing or transfer conditions in the coating module 2 in connection with the properties of the printing material, the adhesive, or the press coating.

The necessary data could be read-in via interfaces directly from data carriers on foil supply rollers and could be changed by means of parameter values from the setting of the transfer process on the coating module 2.

The method related to the foil transfer in the printing or application press shown in FIG. 1 is as follows:

A printing ink is applied on the printing sheet coated with a metalized layer in a printing unit 50 following the coating unit 2. Here, the printing sheet is transferred out from the coating unit 2 by the impression cylinder 4 via a sheet-transfer drum or a sheet-transfer unit to an impression cylinder 40 of the printing unit 50.

The printing unit 50 has, as is usual in offset printing units, the impression cylinder 40, a rubber or blanket cylinder 41 allocated to this impression cylinder, and a plate cylinder 43 allocated to this blanket cylinder. An inking unit and a dampening unit here—shown schematically—are allocated to a plate cylinder 43.

Another printing gap 60 is formed between the impression cylinder 40 and blanket cylinder 41. In this printing gap 60, printing ink is deposited onto the printing sheet from a pressure plate 44 tensioned on the plate cylinder 43. A cover 42 in this case is arranged on the blanket cylinder 41.

The pressure of the printing gap 60 between the surfaces of the blanket cylinder 41 and the impression cylinder 40 is adjustable with the aid of adjustment mechanisms 45 allocated to the blanket cylinder 41. As is known in offset printing, this adjustment setting is determined by the thickness measure of the printing material that is to be processed and printed in the printing gap 60. For this purpose, a printing pressure is necessary, in order to transfer the printing ink from the blanket cylinder 41 to the printing material held on the impression cylinder 40.

In this way, an approximately linear pressure is exerted on the printing sheet in the printing gap 60, wherein this pressure also acts on the image parts of the metallic coating. It is provided here that the pressure in the printing gap 60 be tuned to the pressure provided in the transfer gap 6 for the foil transfer.

For improving the adhesion of the transferred foil parts in connection with a high-quality printing in the printing unit 50, each pressure is selected as a function of the type and elastic property of the coating 42 arranged on the blanket cylinder 41 and the press covering 10 arranged on the press roller 3. On one hand, a hard-elastic coating is advantageously selected for the press roller, which is less adhesive and optionally is very finely profiled in its surface that controls the foil web 5.

On the other hand, a coating suitable for normal ink printing is selected as the blanket or rubber blanket 42 on the blanket cylinder 41, wherein this blanket has an ink-absorbing construction. The blanket or rubber blanket could have a softer construction with respect to its elasticity than is provided for the press covering 10 of the press roller 3.

The pressure of the printing material in the transfer gap 6 or printing gap 60 is produced such that a spacing is set for the functional setting of the elements involved (thus, for the foil transfer or ink printing) so that the gap is smaller by a certain measure than is provided by the thickness of the printing material to be processed. Thus, the printing material is pressed together when passing through the transfer gap 6 or the printing gap 60, in that the coverings (press covering 10 and rubber blanket 42) deform due to their elasticity by the measure that was used for the gap setting.

The settings with respect to the transfer gap 6 are performed by means of additional adjustment mechanisms 46 that are allocated to the press roller 3. The adjustment mechanisms 45, 46 are used, as is common in the art, in offset printing presses on blanket or rubber cylinders of printing units or also on forme cylinders of coating modules.

In printing presses, for controlling the sequences, machine controllers are provided. These machine controllers include all possible settings for the printing unit 50 and also the printing units or application units that function as the coating unit 2 and the application unit 1. Thus, the setting of the gap measurements for the surfaces of the cylinders 3, 4 or 41, 40 can be adjusted via the controller relative to each other for the transfer gap 6 and the printing gap 60.

For this purpose, a control device can be provided in connection with the machine controller or also separately, wherein this control device provides for the adjustment of the printing press for cold-foil transfer and corresponding settings in the printing units. The machine controller of the printing press therefore provides that a special setting be provided for the cold-foil transfer operation.

Figure 2:
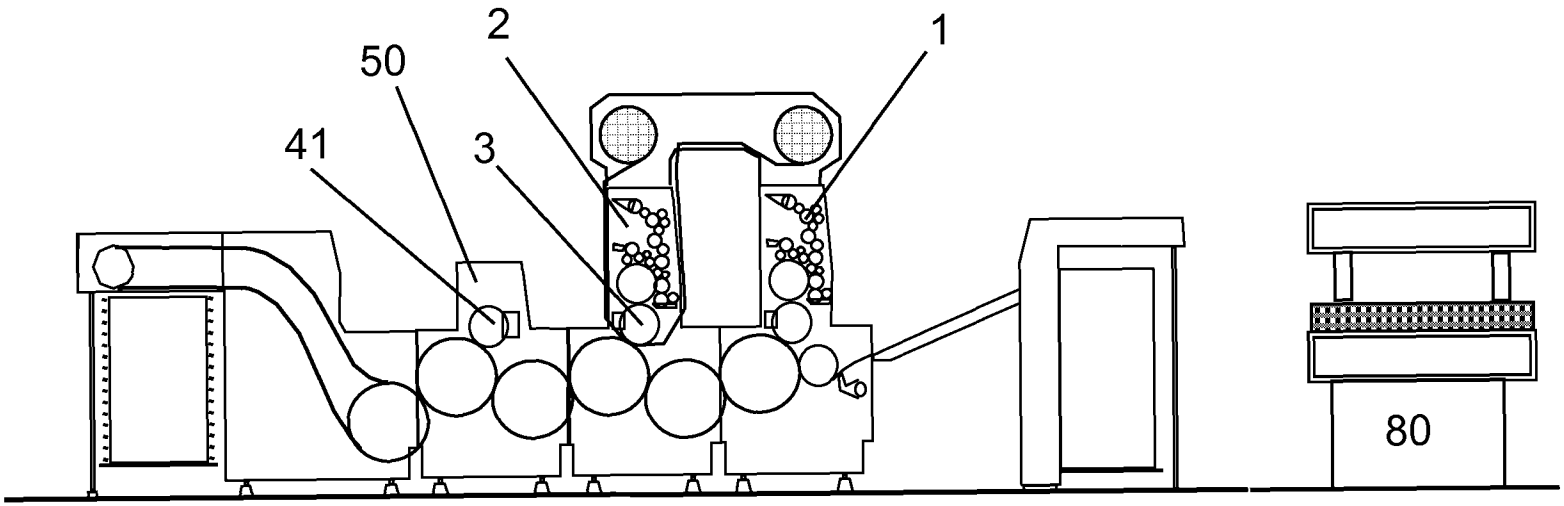
FIG. 2 is a depiction of the illustrated printing press and associated control panel.

Other possible applications of the method can be understood in connection with the diagram according to FIG. 2 in which the printing unit 50 can be a coating module, but is also functionally as a printing unit. Therefore, instead of the illustrated coating module, one printing unit or several printing units could also be used.

In the illustrated embodiment, reading devices 70 for detecting process parameters of the printing press are connected to a control panel 80 or a printing tower of the printing press somewhat above or within its machine controller. The data can then be read out both automatically and also manually and transmitted to the machine controller.

For foil cycle timing, the method according to the invention is carried out so that the cycle timing and the cycle speed are set as a function of the length of the pattern.

According to the contact height and printing material properties and the format surface of the foil transfer in the peripheral direction, the cycle timing can be controlled and limited. As another parameter, printing speed is monitored and controlled.

The conversion of a printing press to a cold-foil transfer with the possibility of foil cycle timing as a function of cylinder channel or the peripheral length of the application pattern is performed in the following way, in order to minimize production costs:

1. At maximum machine speed, the cycle timing is turned off.
2. At maximum machine speed but reduced application surface area, a reduced cycle timing is turned on.
3. At reduced machine speed, the cycle timing is turned on.
4. At reduced machine speed and reduced application surface area, an increased cycle timing up to the maximum is turned on.

To this end, a group of curves of cycle timing settings is allocated to the controller of the printing press, wherein this group of curves is stored in the control panel or the machine controller or is allocated to a work-preparation station. By means of the group of curves, fixed settings or possible selections can be defined with the aid of which the production is performed as a function of the material costs, personnel costs, or production times for an application at the lowest possible level with respect to production costs.

The same can be performed as a function of the requirements of the highest possible quality standard for which optionally the most continuous possible production method is advantageous.

LIST OF REFERENCE SYMBOLS

1 Application unit
2 Coating unit
3 Press roller (3')
4 Impression cylinder
5 Transfer foil/Foil web (5')
6 Transfer gap (6')
7 Roller drive
8 Foil supply roller
9 Foil take-up roller
10 Press covering
11 Inking unit
12 Plate cylinder
13 Rubber cylinder
14 Foil guide roller
15 Printing unit protection
16 Dryer
17 Inspection mechanism
18 Dancer roller
40 Impression cylinder
41 Blanket cylinder
42 Blanket/Rubber blanket
43 Plate cylinder
44 Pressure plate
45 Adjusting mechanism

47 Under-package sheet
48 Marking
50 Printing unit
60 Printing gap
70 Reading gap
80 Control panel

The invention claimed is:

1. A method for the transfer of image-forming layers from a transfer foil to printing sheets provided with an image-specific coating of an adhesive on one side by means of a coating unit of a printing press that includes an impression cylinder and a press roller that form a common transfer gap through which the transfer foil can be guided from a foil supply roller in contact with the press roller with the coated side in contact with the printing sheet guided on the impression cylinder and under pressure for transferring the image forming layers comprising the steps of:

operating the printing press with a foil cycle timing such that the transfer foil is selectively stopped and advanced through the transfer gap, said foil cycle timing being selectively changeable such that it is adjustable in its frequency and period of operation with respect to one press cylinder revolution, controlling by means of a controller the foil cycle timing as a function of a printing press speed, a length of an application, a cost of the transfer foil, and a time requirement for an application, such that:

(a) the foil cycle timing is decelerated when the printing press speed is increased, the length of an application surface is increased, wherein said application surface extends on a sheet in a peripheral direction of a machine cylinder, the cost of the transfer foil is lower, or the time requirement for an application of foil on a sheet is decreased; and (b) the foil cycle timing is accelerated when the printing press speed is decreased, the length of the application surface is decreased, the cost of the transfer foil is higher, or the time requirement for an application of foil on a sheet is increased;

wherein the printing press speed, the length of the application surface, the cost of the transfer foil, and the time requirement for an application of foil are parameters that are input to the controller by a user and are used as a basis for determining an appropriate foil cycle timing based on predetermined relationships in the controller.

2. The method according to claim 1 including storing a group of curves for changing the foil cycle timing as a function of application format for a production application in the machine controller or a work preparation station so that the changing of the foil cycle timing can be turned off or reduced and/or turned on or lengthened under the control of the machine controller or work preparation station.

3. The method according to claim 1 including storing a group of curves for changing the foil cycle timing as a function of foil costs for a production application in the machine controller or a work preparation station so that the changing of the foil cycle timing can be turned off or reduced and/or turned on or lengthened under the control of the machine controller or work preparation station.

4. The method according to claim 1 including storing a group of curves for changing the foil cycle timing as a function of machine speed for a production application in the machine controller or a work preparation station so that the changing of the foil cycle timing can be turned off or reduced and/or turned on or lengthened under the control of the machine controller or work preparation station.

5. The method according to claim 1 including storing a group of curves for changing the foil cycle timing as a function of time target for a production application in the machine controller or a work preparation station so that the changing of the foil cycle timing can be turned off or reduced and/or turned on or lengthened under the control of the machine controller or work preparation station.

6. A method for the transfer of image-forming layers from a transfer foil to printing sheets provided with an image-specific coating of an adhesive on one side by means of a coating unit of a printing press that includes an impression cylinder and a press roller that form a common transfer gap through which the transfer foil can be guided from a foil supply roller in contact with the press roller with the coated side in contract with the printing sheet guided on the impression cylinder and under pressure for transferring the image forming layers comprising the steps of:

directing the transfer foil to the transfer gap, and controlling the direction of the transfer foil to the transfer gap as a function of operating parameters of the press with a foil cycle timing that is changeable between a turned on condition in which foil is advanced to the transfer gap at a predetermined speed, a turned off condition in which advancement of the transfer foil to the transfer gap is stopped, and a selected adjustable condition in which the frequency or period of advancement of the transfer foil to the transfer gap is adjustably changed as a function of the operating parameters of the press, wherein the selected adjustable condition is controlled by means of a controller as a function of a printing press speed, a length of an application, a cost of the transfer foil, and a time requirement for an application such that:

(a) the foil cycle timing is decelerated when the printing press speed is increased, the length of an application surface is increased, wherein said application surface extends on a sheet in a peripheral direction of a machine cylinder, the cost of the transfer foil is lower, or the time requirement for an application of foil on a sheet is decreased; and (b) the foil cycle timing is accelerated when the printing press speed is decreased, the length of the application surface is decreased, the cost of the transfer foil is higher, or the time requirement for an application of foil on a sheet is increased, wherein the printing press speed, the length of the application surface, the cost of the transfer foil, and the time requirement for an application of foil are parameters that are input to the controller by a user and are used as a basis for determining an appropriate foil cycle timing based on predetermined relationships in the controller, which relationships are stored as a group of curves in the controller.

* * * * *